US007486903B2

(12) United States Patent
Asakawa

(10) Patent No.: US 7,486,903 B2
(45) Date of Patent: Feb. 3, 2009

(54) IMAGE FORMING APPARATUS WITH FAN FOR COOLING A DISPLAYING PORTION

(75) Inventor: Yoshiyuki Asakawa, Osaka (JP)

(73) Assignee: Kyocera Mita Corporation (JP)

( * ) Notice: Subject to any disclaimer, the term of this patent is extended or adjusted under 35 U.S.C. 154(b) by 253 days.

(21) Appl. No.: 11/438,892

(22) Filed: May 23, 2006

(65) Prior Publication Data

US 2006/0288331 A1 Dec. 21, 2006

(30) Foreign Application Priority Data

Jun. 7, 2005 (JP) ..... 2005-166820

(51) Int. Cl.
*G03G 21/20* (2006.01)

(52) U.S. Cl. ..... 399/91; 399/107

(58) Field of Classification Search ..... 399/75, 399/81, 91, 92, 94, 107, 108, 405; 362/632
See application file for complete search history.

(56) References Cited

U.S. PATENT DOCUMENTS 6,795,662 B2 * 9/2004 Kudo ..... 399/81
6,819,891 B2 * 11/2004 Suzuki ..... 399/81
6,934,502 B2 * 8/2005 Okuda ..... 399/379
7,062,197 B2 * 6/2006 Kunugi ..... 399/107
2006/0245214 A1 * 11/2006 Kim ..... 362/632

FOREIGN PATENT DOCUMENTS

JP 11-119498 4/1999

* cited by examiner

*Primary Examiner*—Hoan H Tran
(74) *Attorney, Agent, or Firm*—Gerald E. Hespos; Anthony J. Casella

(57) ABSTRACT

A copying machine (image forming apparatus) including an operation displaying portion, a fan and a middle discharging portion. The operation displaying portion includes a color liquid crystal which can be rotated with respect to a main body of the copying machine displaying panel and is adapted to display information concerning the copying machine. The fan is provided in the operation displaying portion and is adapted to cool the operation displaying portion. The middle discharging portion is provided in a back of the operation displaying portion, and a recording sheet is discharged therein. Further, the operation displaying portion includes a back surface casing having an air hole, and the fan is capable of sending air through the air hole of the operation displaying portion toward a recording sheet which is discharged in the middle discharging portion.

16 Claims, 10 Drawing Sheets

IMAGE FORMING APPARATUS WITH FAN FOR COOLING A DISPLAYING PORTION

BACKGROUND OF THE INVENTION

1. Field of the Invention

The invention relates to an image forming apparatus comprising a displaying portion for displaying information concerning the apparatus.

2. Description of the Related Art

Conventionally, as described in Japanese Unexamined Patent Publication No. HEI11-119498, an image forming apparatus comprising a displaying portion for displaying information concerning the apparatus is known. The Japanese Unexamined Patent Publication No. HEI11-119498 discloses an electronic imaging apparatus (image forming apparatus) which is so constructed that an inclination angle of an operating portion including a liquid crystal displaying panel (displaying portion) with respect to a horizontal plane can be changed so as to enable a user (operator) who is in a state of sitting on a chair to easily operate the apparatus.

Meanwhile, in recent years, there is a tendency to incorporate a large-sized liquid crystal color display panel in an image forming apparatus so as to enhance the visibility of the displaying portion. For this reason, the processing speed of a CPU (Central Processing Unit) mounted in the displaying portion as a displaying circuit becomes higher.

In such image forming apparatus described above, with the high processing speed of the CPU mounted in the displaying portion, the amount of heat generated by the CPU also increases. It is required to suppress excessive rise in temperature of the displaying portion due to such increase in the amount of heat generated by the CPU.

SUMMARY OF THE INVENTION

The present invention has worked out in view of the problems described above, and its object is to provide an image forming apparatus which is capable of suppressing the excessive rise in temperature of the displaying portion.

In order to achieve the object, according to an aspect of the invention, an image forming apparatus is provided with a displaying portion for displaying information concerning the image forming apparatus. The displaying portion is movable with respect to a main body of the image forming apparatus. The apparatus is provided with a fan for cooling the displaying portion. The fan is mounted in the displaying portion.

As described above, the fan for cooling the displaying portion for displaying information concerning the apparatus is provided. Accordingly, the displaying portion can be sufficiently cooled even if the amount of heat generated by the CPU of the displaying circuit mounted in the displaying portion increases due to use of the large-sized color liquid displaying panel as a displaying element in the displaying portion. Consequently, the excessive rise in temperature of the displaying portion can be suppressed.

Further, a fan which is movable with respect to the main body of the image forming apparatus is provided in the displaying portion. Accordingly, the position of the displaying portion with respect to the main body of the image forming apparatus can be changed. Accordingly, the direction of an air flow generated by the fan from the displaying portion can be easily changed. Consequently, the temperature rising portion of the main body of the image forming apparatus can be easily cooled by sending an air from the displaying portion.

DETAILED DESCRIPTION OF THE PREFERRED EMBODIMENT

Hereinafter, an embodiment of the invention is described with reference to the drawings.

Figure 1:
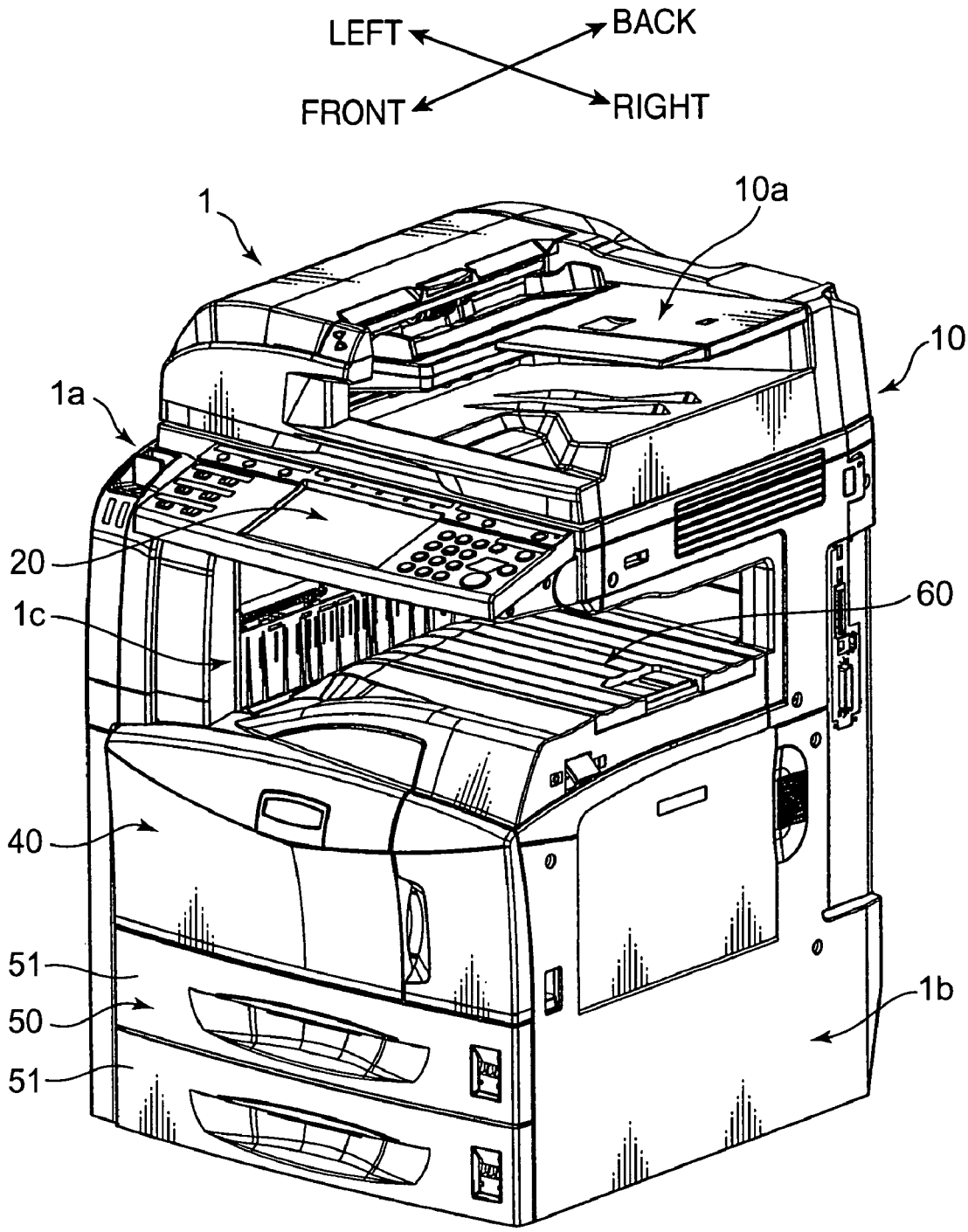
FIG. 1 is a perspective view showing an overall construction of a copying machine according to an embodiment of the invention.
Figure 2:
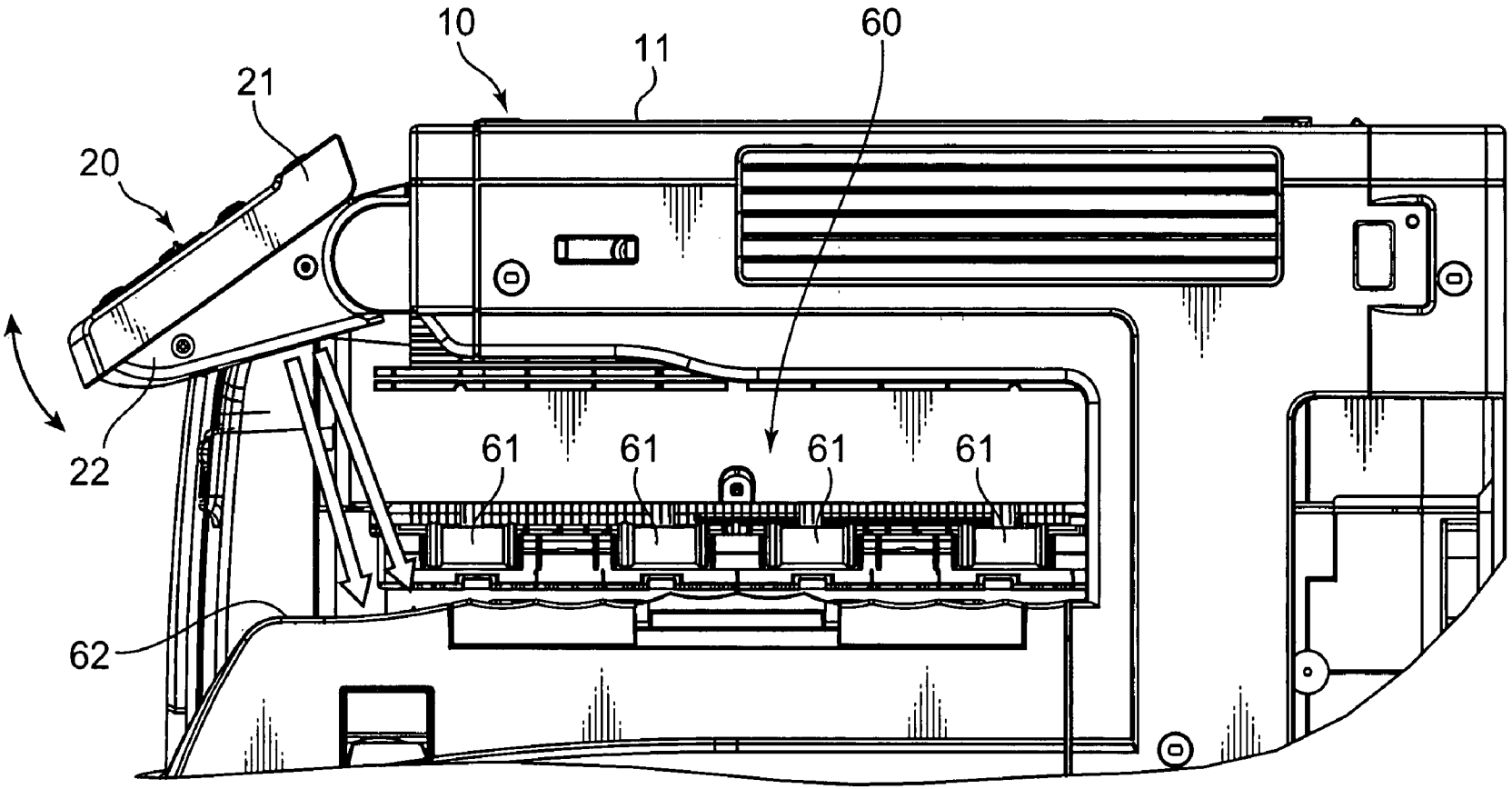
FIG. 2 is a side view showing a part of the copying machine according to the embodiment shown in FIG. 1 viewing from right hand.
Figure 3:
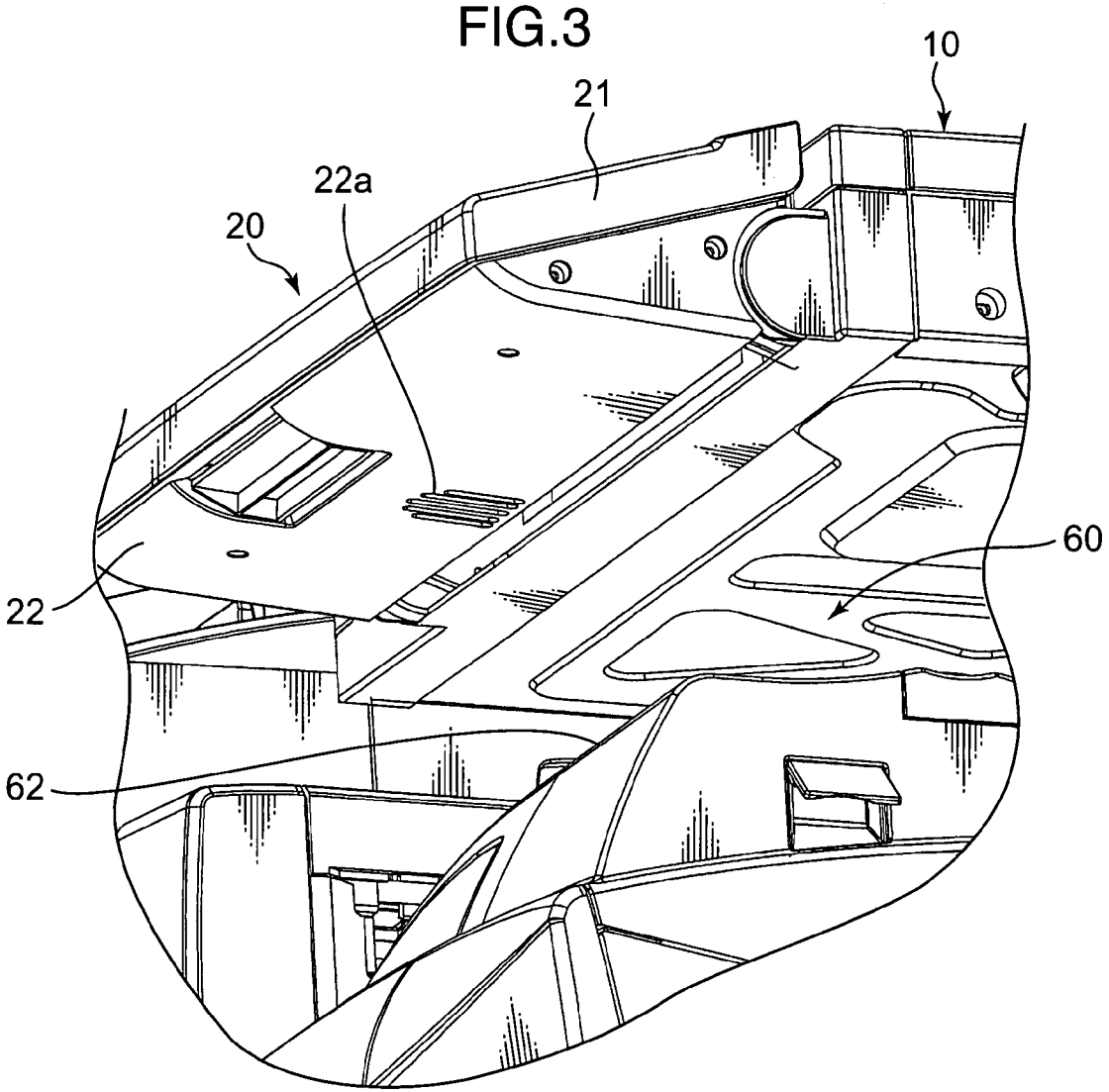
FIG. 3 is a perspective view showing a part of the copying machine according to the embodiment shown in FIG. 1 viewing in an obliquely downward direction from front and right hand.

FIGS. 1 to 3 are views showing a construction of a copying machine according to an embodiment of the invention. FIGS. 4 to 7 are views showing a construction of an operation displaying portion provided in the copying machine shown in FIG. 1. FIG. 8 is a block diagram showing an electric construction of the copying machine shown in FIG. 1. At first, an overall construction of a copying machine 1 according to the embodiment of the invention is described with reference to FIG. 1. In the embodiment, a copying machine 1 is described as an image forming apparatus to which the invention relates.

As shown in FIG. 1, the copying machine 1 according to the embodiment of the invention includes an upper section 1*a* for reading a document image and a lower section 1*b* provided under the upper section 1*a* for forming an image on a recording sheet or a paper sheet. Further, the copying machine 1 includes a space 1*c* between the upper section 1*a* and the lower section 1*b*. The space 1*c* extends inward horizontally from the right front portion of the copying machine 1. In the space 1*c*, a middle discharging portion 60 for stacking a recording sheet which is to be discharged from the lower section 1*b* is provided. The lower section 1*b* is to be described hereinafter. It should be noted that the middle discharging portion 60 is a discharging portion.

The upper section 1*a* includes a document reading portion 10 for reading a document image and an operation displaying portion 20 located in front of the document reading portion 10 for inputting an instruction in accordance with an operation by a user (operator). Namely, in the copying machine 1 according to the embodiment, the middle discharging portion 60 is provided on a back of the operation displaying portion 20. It should be noted that the operation displaying portion 20 is a displaying portion. Further, on upper portion of the document reading portion 10, a document feeding portion 10*a* (ADF: Automatic Document Feeder) for automatically conveying a document one at a time to the document reading portion 10 is provided. The document feeding portion 10*a* is movably mounted so as to enable opening and closing an upper surface of the document reading portion 10.

In addition to the function of reading a document image, the image reading portion 10 has a function to generate an image data corresponding to the read document image. As shown in FIG. 2, the document reading portion 10 includes a scanner (unillustrated) and a contact glass 11. The scanner has a CCD (Charge Coupled Device) sensor, an exposure lamp and the like for optically obtaining a document image to generate image data. The contact glass 11 is located on an upper surface of the scanner and is adapted to read a document image. The document reading portion 10 is constructed so as to output information such as the image data to a controller 70 (as referred to FIG. 8). The image data outputted to the controller 70 is obtained from a document which is placed on the contact glass 11 and a document which is conveyed by the document feeding portion 10*a* so as to come in contact with the contact glass 11.

Figure 4:
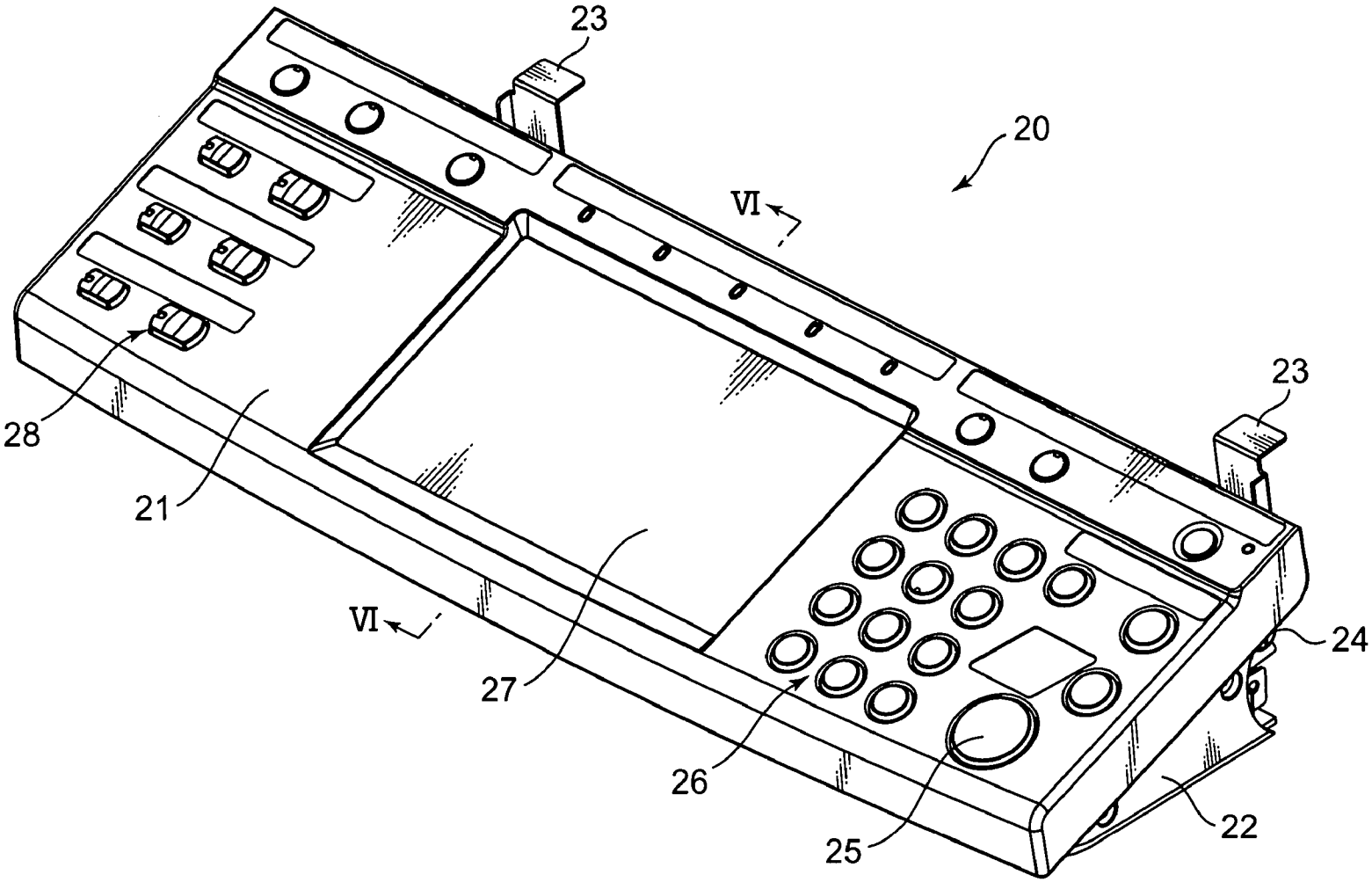
FIG. 4 is a perspective view showing an operation displaying portion of the copying machine according to the embodiment shown in FIG. 1.
Figure 5:
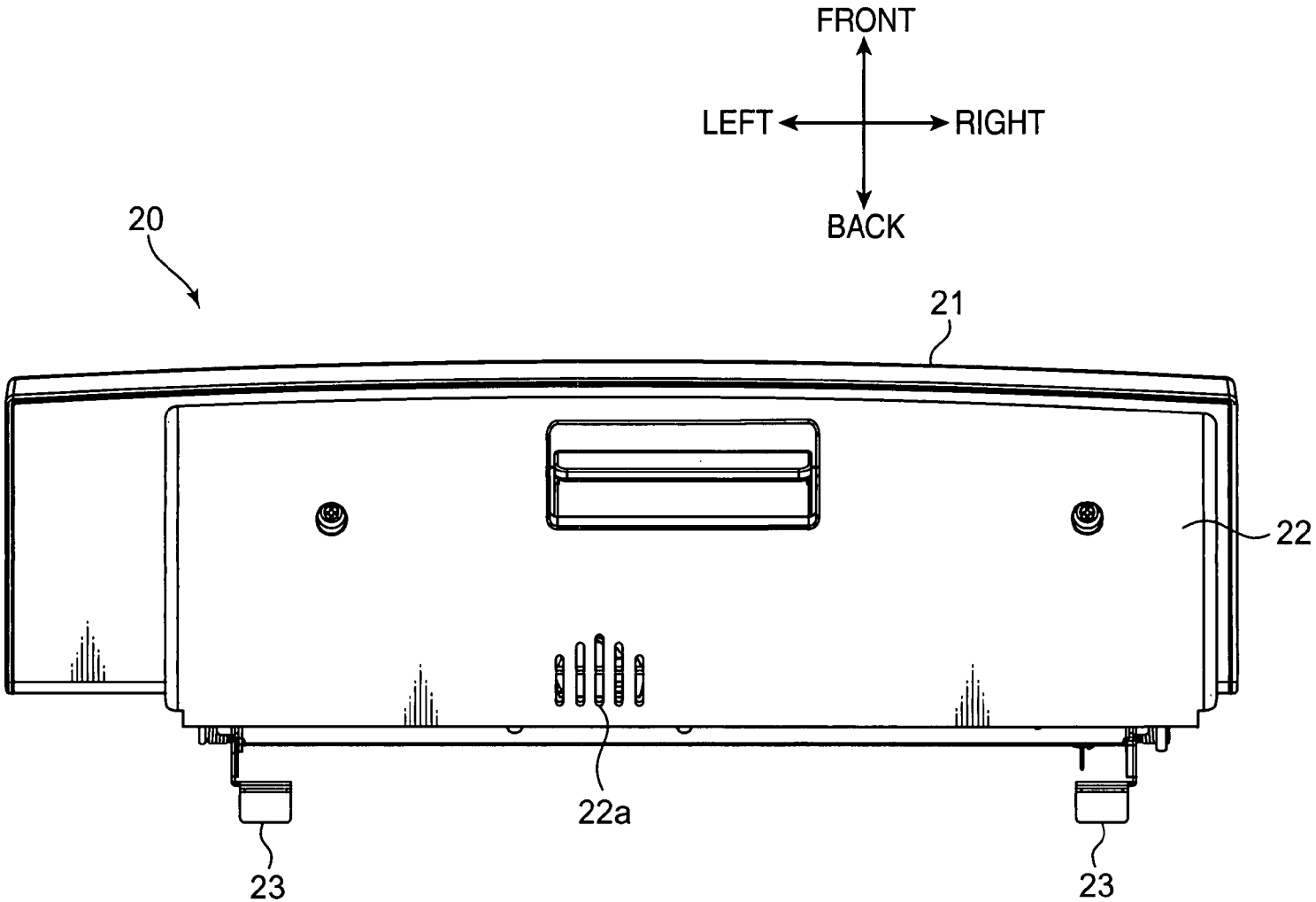
FIG. 5 is a back view of the operation displaying portion shown in FIG. 4.
Figure 6:
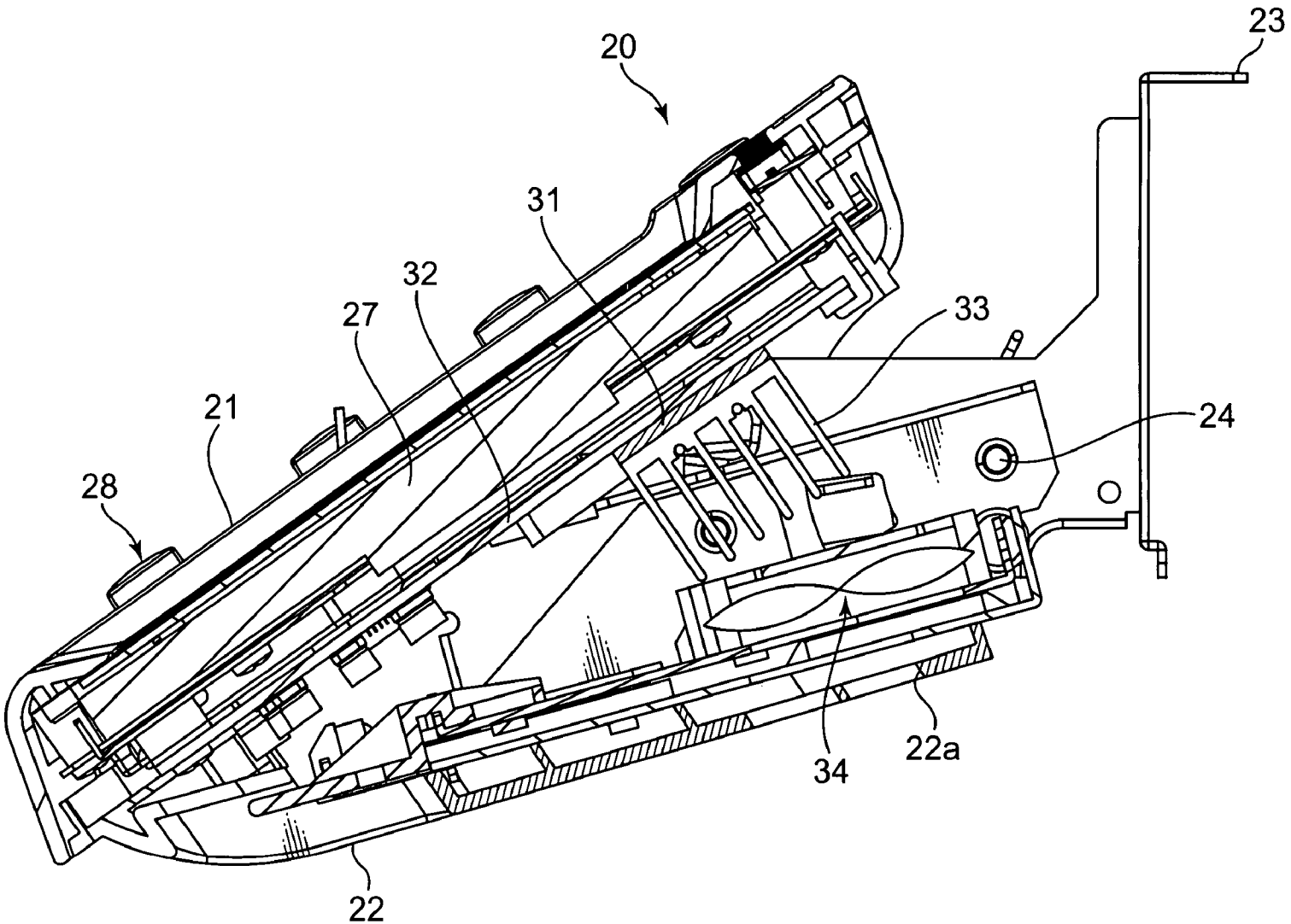
FIG. 6 is across-sectional view of the operation displaying portion shown in FIG. 4 taken along the line VI-VI.

Herein, in the embodiment, as shown in FIGS. 1 to 3, the operation displaying portion 20 has a structure (housing structure) which is separate and independent from a main body of the copying machine 1 and is movable (rotatable) with respect to the main body of the copying machine 1. Namely, as shown in FIGS. 4 to 6, the operation displaying portion 20 includes an operation displaying unit 21 for enabling the user to input instructions and a supporting unit 22 for supporting the operation displaying unit 21 from lower side. The supporting unit 22 is attached to the main body of the copying machine 1 with an attaching member 23. Further, as shown in FIG. 6, the supporting unit 22 is attached to the attaching member 23 through a shaft 24 which allows the operation displaying unit 21 to rotate about the shaft 24. An angle of rotation of the operation displaying unit 21 with respect to the main body is adjustable in a plurality of steps. Accordingly, a panel of the operation displaying portion 20 can be slanted in vertical directions so as to face in front direction of the machine. Consequently, a user (an operator) who is in a state of sitting on a chair, for example, can easily operate the copying machine 1.

As shown in FIG. 4, the operation displaying unit 21 includes a start key 25 for enabling the user to input an instruction to start copying, numerical keys 26 for enabling the user to input the number of copies to be printed, a touch-panel color liquid crystal display panel (LCD) 27 which displays operation guide information for enabling the user to input settings of copying performance and a variety of operation buttons, and function buttons 28 for enabling the user to instruct execution of various types of functions which the copying machine 1 can perform. Further, as shown in FIG. 6, the operation displaying unit 21 includes a display circuit board 32 and a radiator (heat sink) 33. The display circuit board 32 is attached on a back of the liquid crystal display panel 27 and is provided with a CPU 31 which is a heat generative component. The radiator 33 is provided adjacent to the display circuit board 32 and has a function of cooling the CPU 31. Further, since the liquid crystal display panel 27 is a color display type in the embodiment, the CPU 31 which is capable of processing in high speed is provided in the operation displaying unit 21. The CPU 31 generates large amount of heat.

Figure 7:
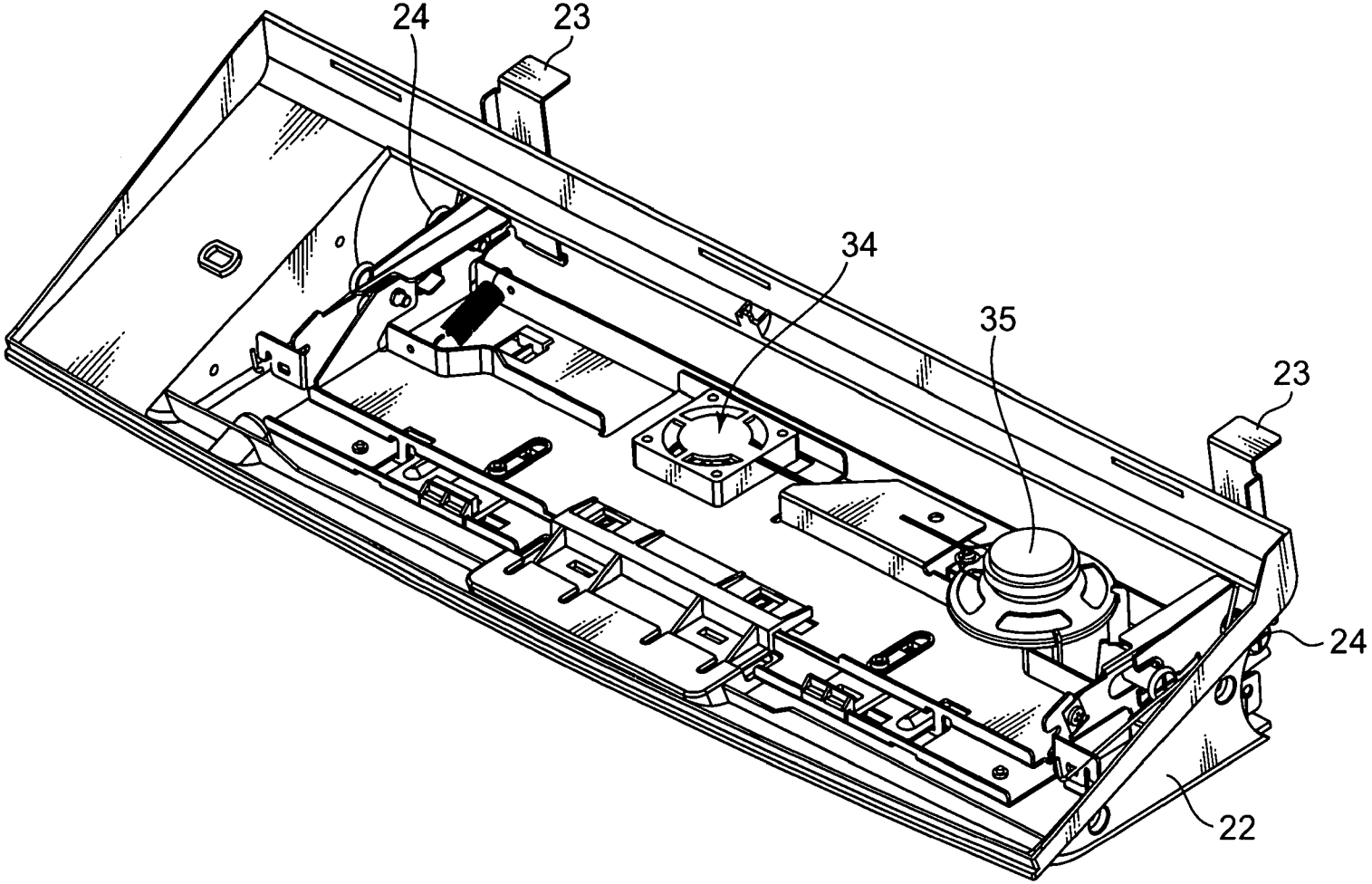
FIG. 7 is an exploded perspective view illustrating an inner structure of the operation displaying portion shown in FIG. 4.
Figure 8:
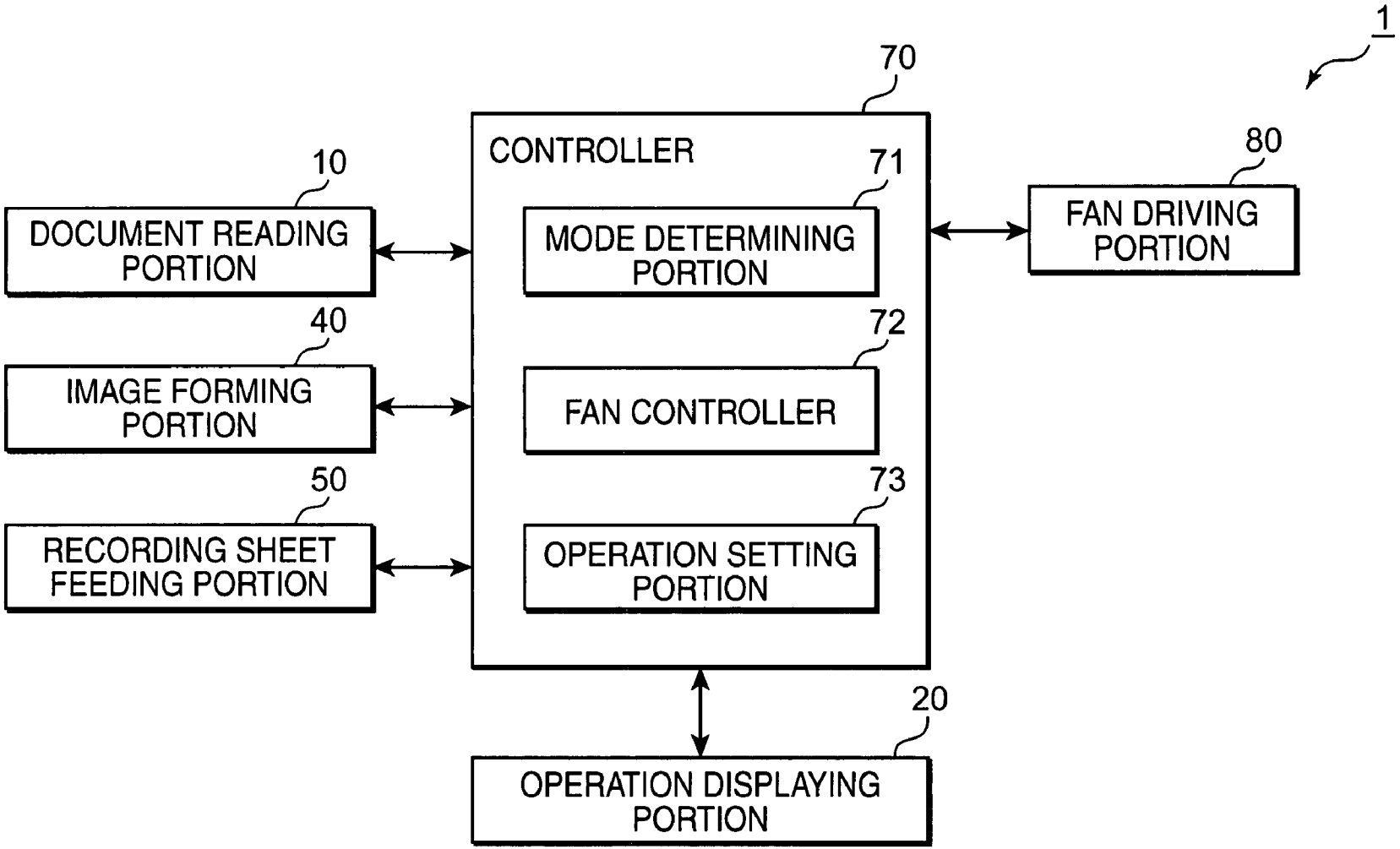
FIG. 8 is a block diagram showing an electric construction of the copying machine according to the embodiment shown in FIG. 1.

Further, in the embodiment, as shown in FIG. 7, a fan 34 for cooling an inner part of the operation displaying portion 20 is provided near the central part of an inner surface of the supporting unit 22. Further, as shown in FIGS. 5 and 6, an air hole 22*a* for passing an air flow from the fan 34 is formed in the supporting unit 22 at a position corresponding to the fan 34. As shown in FIG. 6, while the supporting unit 22 supports the operation displaying unit 21, the fan 34 is housed in the operation displaying portion 20 and located near the edge of the heat radiator 33. By providing the fan 34 to the supporting unit 22 in such a manner that the fan 34 is housed in the operation displaying portion 20 as described above, the operation displaying portion 20 can be suppressed from being grown in size in contrast to the case where the fan 34 is mounted outside the operation displaying portion 20.

The copying machine 1 according to the embodiment is so constructed that the middle discharging portion 60 in the space 1*c* is provided on a back of the operation displaying portion 21. Consequently, an air flow generated by driving the fan 34 housed in the operation displaying portion 20 cools the inner portion of the operation displaying portion 20 and then is sent to the middle discharging portion 60 in the space 1*c* through the air hole 22*a* formed in the supporting unit 22. Further, the operation displaying portion 20 is constructed so as to be rotatable with respect to the main body of the copying machine 1. Consequently, a direction of the air flow coming out from the operation displaying portion 20 may be changed so that the air flows the end of the middle discharging portion 60.

Further, the controller 70 (refer to FIG. 8), which is to be described hereinafter, controls the fan 34 so as to rotate at a high speed (full speed) when the copying machine 1 operates copying and at a low speed (half speed: about one-half a rotational speed of the full speed) when the copying machine 1 is in a standby state (a state where the copying is not operated). Furthermore, the fan 34 is controlled so as to rotate at the low speed (half speed) when the only one recording sheet is discharged (single discharging) in the middle discharge portion 60. Furthermore, since the amount of heat generated by the CPU 31 becomes relatively small when the copying machine 1 is in a sleeping mode (power-saving state) where the liquid crystal display panel 27 is turned off if no instruction has been inputted for a predetermined time, the fan 34 is controlled so as to stop. Consequently, undesired sound and consumption of electricity due to driving of the fan 34 can be suppressed.

Further, since the operation displaying portion 20 according to the embodiment has a structure in which the fan 34 and the CPU 31 mounted on the circuit board 32 are placed adjacent to each other, a sufficient cooling effect of the fan 34 with respect to the CPU 31 can be achieved. However, for example, in the case where an air intake duct (unillustrated) which connects the fan 34 and the CPU 31 is provided in the operation displaying portion 20, a strong air flow can be generated near the CPU 31 located at the entrance of the air intake duct. Accordingly, the CPU 31 mounted on the circuit board 32 can be cooled more efficiently. Consequently, it may be preferable that such air intake duct is provided in the operation displaying portion 20. In this case, since a strong air flow is generated near the heat radiator 33 located at inner portion of the air intake duct, a cooling effect of the heat radiating plate 33 with respect to the CPU 31 is also enhanced. Furthermore, in the embodiment, in the case where the fan 34 and the air hole 22*a* of the supporting unit 22 are located at positions apart from each other, an air exhaust duct (unillustrated) which connects the fan 34 and the air hole 22*a* may be provided in the operation displaying portion 20. It should be noted that the air intake duct and the air exhaust duct are examples of the "duct".

As shown in FIG. 7, a speaker 35 as a sound generator of the copying machine 1 is provided in inner part of the supporting unit 22.

As shown in FIG. 1, the lower section 1*b* includes an image forming portion 40 for forming an image on a recording sheet and a sheet feeding portion 50 for feeding the recording sheet to the image forming portion 40.

The image forming portion 40 has a function of forming (printing) an image based on an image data obtained in the document reading portion 10 on a recording sheet which is conveyed from the sheet feeding portion 50. Though it is not illustrated, the image forming portion 40 has a known construction including: a photoconductive drum which is rotatably provided; a charging portion, a laser scanning unit, a developing portion, a transferring roller and a cleaning portion which are located around the photoconductive drum; a heat-inducting image fixing portion located at downstream of the photoconductive drum; and a recording sheet conveyance passage for conveying the recording sheet from the image forming portion 40 to the middle discharging portion 60. Further, the image fixing portion is constructed so as to heat the toner of the image formed on a surface of the recording sheet which passes through a contacting portion between a heat roller and a pressing roller and fix the image on the recording sheet by a pressure which the pressing roller exerts. Consequently, the recording sheet after having been passed through the image fixing portion and discharged in the middle discharging portion 60 has a relatively high temperature.

The recording sheet feeding portion 50 has a pair of recording sheet feeding cassettes 51 which are vertically aligned. Each recording sheet feeding cassette 51 is capable of storing recording sheets of respective sizes (for example, A3, A4, B4 and B5). A recording sheet is conveyed from the recording sheet feeding cassette 51 to the image forming portion 40 through a conveyance passage (unillustrated).

As shown in FIG. 2, the middle discharging portion 60 includes a discharging roller 61 for discharging a recording sheet which is conveyed from the image forming portion 40 in the middle discharging portion 60 and a recording sheet discharging tray 62 for stacking the recording sheet which is discharged.

In the embodiment, as shown in FIG. 8, the copying machine 1 includes a controller 70 having a CPU for executing an arithmetic processing, a ROM for storing a processing program and a data, and a RAM for temporarily storing a data. The controller 70 is electrically connected to the document reading portion 10, the operation displaying portion 20, the image forming portion 40, the paper feeding portion 50 and a fan driving portion 80 and has a function to control the respective operation of the document reading portion 10, the image forming portion 40 and the paper feeding portion 50 based on conditions such as a paper size, a scale factor, a density and a number set in the operation displaying portion 20.

The controller 70 includes a mode determining portion 71, a fan controller 72 and an operation setting portion 73 for operating the fan driving portion 80. The mode determining portion 71 has a function of determining, among three operation modes stored in the ROM, an operation mode which corresponds to an operation to discharge the recording sheet in the middle discharging portion 60 of the copying machine 1 and output a determination signal to the operation setting portion 73. The fan controller 72 has a function of generating a control signal to drive the fan 34 according to a rotational speed set in the operation setting portion 73 and output the control signal to the fan driving portion 80. The operation setting portion 73 has a function of reading a determination signal transmitted from the mode determining portion 71 and set a rotational speed of the fan 34 which respectively corresponds to the three operation modes. In the embodiment, the three operation modes include a first mode which makes the fan 34 rotate at the full speed, a second mode which makes the fan 34 rotate at the half speed (about one-half a rotational speed of the full speed) and a third mode which makes the fan 34 stop.

Figure 9:
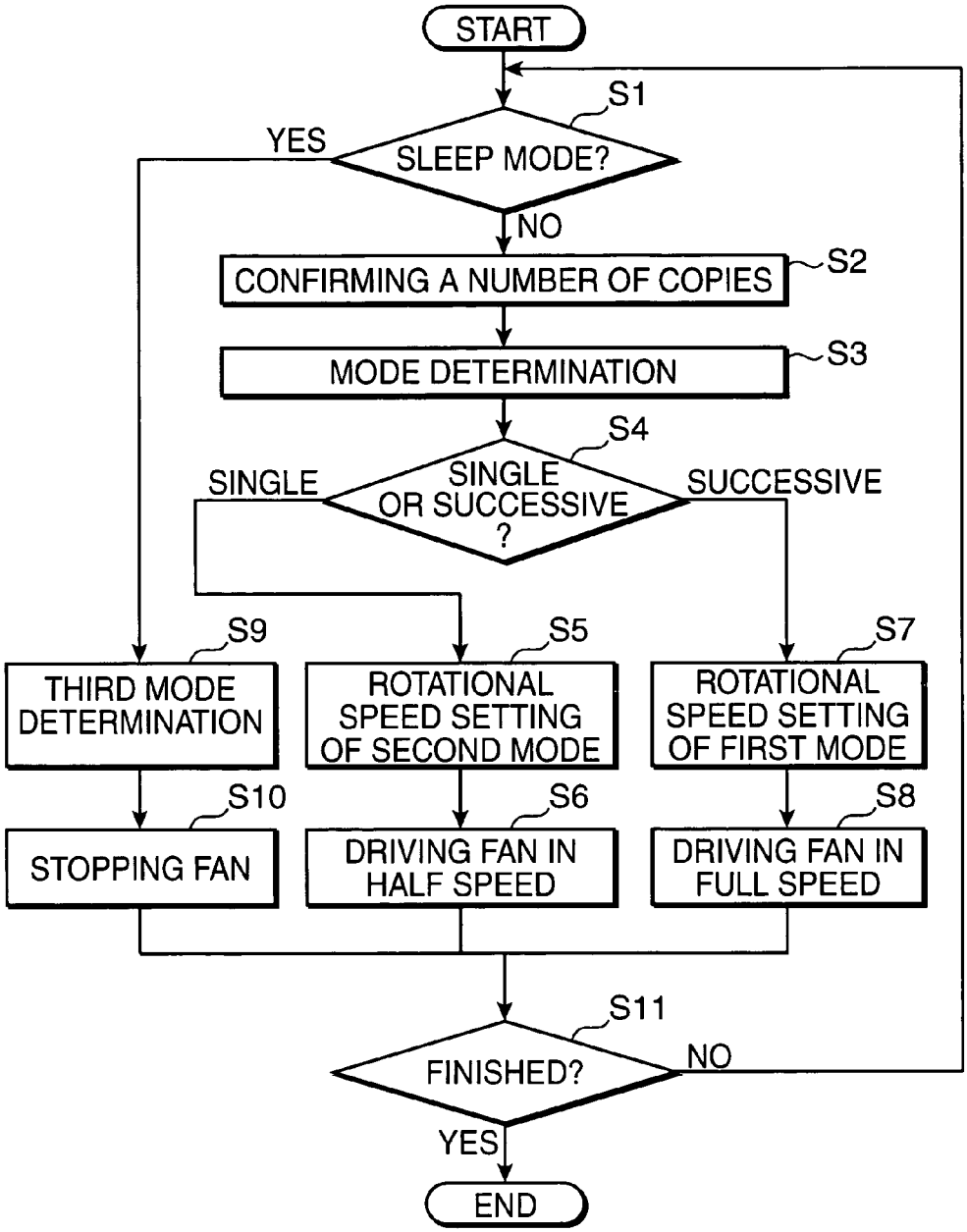
FIG. 9 is a flowchart showing a driving operation of a fan of the copying machine according to the embodiment shown in FIG. 1.

Next, the driving operation of the fan 34 of the copying machine 1 made by the controller 70 is described with reference to a flowchart shown in FIG. 9.

When the apparatus is in a start-up state after being applied with a power, the mode determining portion 71 of the controller 70 determines whether the state of the copying machine 1 is in a sleep mode or not. (step S1) If the copying machine 1 is not in the sleep mode ("NO" in step S1), the mode determining portion 71 confirms the number of copies set in the copying machine 1. (step S2) Based on the number of copies, the operation mode determination is made. (step S3) Namely, if the user operates the numerical keys 26 of the operation displaying portion 20 to input the number of copies with respect to the image data obtained in the document reading portion 10, the input signal is transmitted from the operation displaying portion 20 to the controller 70. Then, the controller 70 makes a determination of the operation mode of the fan 34. Then, either a single discharging or a successive discharging is made is determined. (step S4)

Specifically, if only one recording sheet is set in the document feeding portion 10*a* and the number of copies is inputted in the operation displaying portion 20 as one sheet, the mode determining portion 71 outputs a predetermined signal which instructs the copying machine 1 to execute an operation mode by which only one recording sheet (single discharging) is discharged in the middle discharging portion 60 in the next step. This determination signal is read out in the operation setting portion 73. In such a case, since it is not necessary to consider if the recording sheet discharged in the middle discharging portion 60 sticks to other recording sheet by heat, the rotational speed of the fan 34 corresponding to the second mode is set by the operation setting portion 73. (step S5) Then, the fan controller 72 generates a fan control signal which corresponds to the rotational speed corresponding to the second mode and outputs the control signal to the fan driving portion 80. Consequently, the fan 34 is rotated at the half speed. (step S6)

On the other hand, if only one recording sheet is set in the document feeding portion 10*a* and the number of copies is inputted in the operation displaying portion 20 as more than one, the mode determining portion 71 outputs a predetermined signal which instructs the copying machine 1 to execute an operation mode by which a plurality of recording sheets (successive discharging) are successively discharged in the middle discharging portion 60 in the next step. This determination signal is read out by the operation setting portion 73. In such a case, since there is a possibility that each of the recording sheet discharged in the middle discharging portion 60 sticks to the other by heat, the rotational speed of the fan 34 corresponding to the first mode is set by the operation setting portion 73. (step S7) Then, the fan controller 72 generates a fan control signal which corresponds to the rotational speed corresponding to the first mode and outputs the control signal to the fan driving portion 80. Consequently, the fan 34 is rotated at the full speed. (step S8)

Since a plurality of recording sheets are successively discharged in the middle discharging portion 60 also in the case where a plurality of recording sheets are set in the document feeding portion 10*a*, the rotational speed of the fan 34 corresponding to the first mode is set by the operation setting portion 73. Consequently, the fan 34 is rotated at the full speed.

If the mode determining portion 71 determines in the step S1 that the copying machine 1 is in the sleep mode, (step S1) the determining portion 71 decides to make driving of the fan 34 be shifted to the third mode (step S9) so as to stop the rotation of the fan 34. (step S10) The rotation of the fan 34 may be controlled so as to be driven at a low speed instead of being completely stopped.

In the next step, it is checked whether an instruction signal for terminating an operation is sent to the copying machine 1 or not. If the operation is not terminated, ("NO" in step S11) the process goes back to the step S1 and is repeated.

According to the copying machine 1 of the embodiment as described above, the fan 34 for cooling the operation displaying portion 20 for displaying information concerning the copying machine 1 is provided. Accordingly, the operation displaying portion 20 can be sufficiently cooled if large amount of heat is generated by the CPU 31 mounted on the display circuit board 32 housed in the operation displaying portion 20 for use with the color liquid crystal display panel 27. Consequently, excessive rise in temperature of the operation displaying portion 20 can be suppressed.

Further, in the embodiment, the fan 34 provided in the operation displaying portion 20 which is rotatable with respect to the main body of the copying machine 1, and the air hole 22*a* is formed in a back surface of the operation displaying portion 20. Accordingly, an angle of inclination of the operation displaying portion 20 with respect to the main body of the copying machine 1 may be changed so that a direction of the air flow generated by the fan 34 coming out from the operation displaying portion 20 can be easily changed. Accordingly, the air flow generated by the fan 34 can be supplied to the recording sheets discharged in the middle discharging portion 60 through the air hole 22*a* so that the recording sheets having a high temperature discharged in the middle discharging portion 60 after having been subjected to the image forming processing can be cooled. Consequently, if a plurality of recording sheets are successively discharged in the middle discharging portion 60, the fan 34 does not only suppress an excessive rise in temperature of the operation displaying portion 20 but also suppresses sticking of recording sheets discharged in the middle discharging portion by heat.

The embodiment disclosed herewith should be considered illustrative and not restrictive. The scope of the invention is defined by the claims rather than by the description above, and all changes that fall within metes and bounds of the claims, or equivalence of such metes and bounds are therefore intended to embraced by the claims.

For example, in the foregoing embodiment, a copying machine, which is an image forming apparatus, is described. However, the invention is not limited to copying machines. The invention can be applied to image forming apparatuses other than the copying machines, e.g., a facsimile machine and a scanner.

Figure 10:
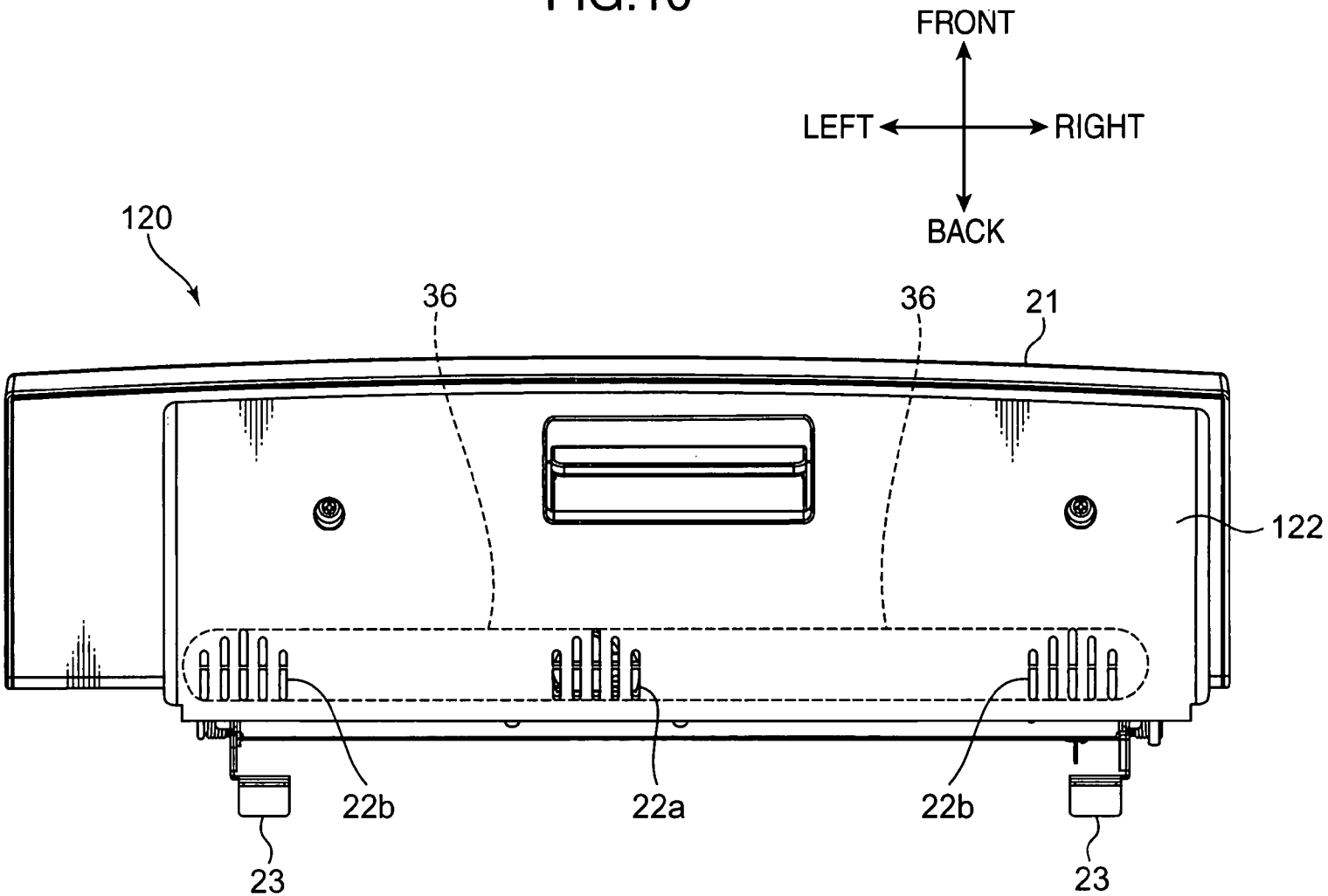
FIG. 10 is a back view showing an operation displaying portion according to a modification of the embodiment of the invention.

Further, in the foregoing embodiment, as shown in FIG. 5, the manner of forming the air hole 22*a* in the supporting unit 22 at a position corresponding to the position of the fan 34 is described. However, the invention is not limited to such manner. As shown in FIG. 10, in addition to the air hole 22*a*, a pair of air holes 22*b* may be formed at a predetermined interval from the air hole 22*a*. With this construction, an air flow generated by the fan 34 comes out not only from a center portion of the back surface of the operation displaying portion 120 but also from the opposite ends. Consequently, an air can be more uniformly sent to the recording sheets discharged in the middle discharging portion 60 regardless of sizes of paper sheet (such as A3, A4, B4 and B5). Further, since the operation displaying portion 120 is so constructed that the air holes 22*b* formed near the opposite ends of the supporting unit 122 and the fan 34 are formed apart from each other in the above-described construction, it may be preferable that a pair of exhausting ducts 36 which connect the fan 34 and each of the air holes 22*b* are provided in the operation displaying portion 120. Further, the operation displaying portion 120 is a displaying portion, and the exhausting duct is a duct. Consequently, a directivity of the air flow generated by the fan 34 coming out from the pair of air hole 22*b* to the middle discharging portion 60 can be enhanced so that the recording sheets discharged in the middle discharging portion 60 can be more efficiently cooled. Further, the air holes 22*a* and 22*b* may be formed on the side surfaces of the operation displaying unit 20 (120), and the number of air holes 22*a* and 22*b* formed in the operation displaying portion 20 (120) is not limited to the embodiment or the modified embodiment.

Further, in the foregoing embodiment, the manner of setting the rotational speed of the fan to be about one-half of the full speed when only one recording sheet is discharged (single discharging) to the middle discharging portion is described. However, the invention is not limited to such manner. As long as the inner part of the operation displaying portion 20 can be sufficiently cooled, the rotational speed at the time of the single discharging may be one-fourth of that of the full speed.

In the above, the invention is described with reference to the copying machine 1 which is one of the embodiments of the invention. However, according to an aspect of the invention, generally, an image forming apparatus comprises: a main body; a displaying portion for displaying information concerning the image forming apparatus, the displaying portion being movable with respect to the main body of the image forming apparatus; and a fan for cooling the displaying portion, the fan being mounted in the displaying portion.

As described above, by providing the fan for cooling the displaying portion for displaying information concerning the image forming apparatus, the displaying portion can be sufficiently cooled even if the amount of heat generated by a CPU mounted of the display circuit housed in the displaying portion increases due to the use of a large-sized color liquid crystal displaying panel as a displaying element of the displaying portion. Consequently, an excessive rise in temperature of the displaying portion can be suppressed. Further, since the fan is provided in an inner portion of the displaying portion, increase in the size of the displaying portion can be suppressed, differing from the case where the fan is provided on an outer portion of the displaying portion.

Further, by providing the fan in the displaying portion which can be moved with respect to the main body of the image forming apparatus, a position of the displaying portion with respect to the main body of the image forming apparatus can be changed. Accordingly, a direction of an air flow which comes out from the displaying portion can be easily changed. Consequently, by sending an air from the displaying portion to temperature raised portions of the main body of the image forming apparatus, the temperature-raised portions can be easily cooled.

It may be preferable that the image forming apparatus having the construction as described above further comprises a discharging portion in which a recording sheet is discharged, the discharging portion being provided on a back of the displaying portion, wherein the displaying portion includes a back surface casing having an air hole, and the fan is operable to send air to a recording sheet discharged in the discharging portion through the air hole. With this construction, an air flow generated by the fan can be supplied to the recording sheet discharged in the discharging portion through the air hole formed in the back surface of the displaying portion so that a recording sheet which is high in temperature discharged in the discharging portion after having been subjected to an image forming processing can be cooled. Consequently, when a plurality of recording sheets are discharged successively in the discharging portion, not only an excessive rise in temperature of the displaying portion is suppressed but also sticking of recording sheets discharged in the discharging portion due to a heat.

In the image forming apparatus described above, the displaying portion includes a duct for leading an air flow generated by the fan to at least either one of the fan or the air hole. With this construction, if the duct for leading an air flow generated by the driving of the fan is provided, a strong air flow can be generated near the entrance or in an inner part of the duct (intake duct). Consequently, a member which is located near the entrance or in inner part of the intake duct can be efficiently cooled. Further, if the duct for leading an air flow generated by driving the fan to an air hole is provided in the displaying portion, the air flow generated by the fan passes through the exhausting duct without diffusing so that a directivity of the air flow generated by the fan coming out of the air hole formed in the displaying portion is enhanced and an air force can be increased. Accordingly, the air which comes out of the displaying portion is efficiently sent to the recording sheet discharged in the discharging portion. Consequently, the recording sheet can be sufficiently cooled.

It may be preferable that the image forming apparatus described above, further comprises a controller which controls the fan so as to rotate at a first predetermined speed when the apparatus is in a standby state and at a second predetermined speed faster than the first predetermined speed when the apparatus is in an operation state. With this construction, the fan is controlled by the controller so as to rotate at a low speed when the apparatus is in a standby state and at a high speed when the apparatus is in an operation state. Consequently, differing from the case where the fan is always rotated at the high speed, undesired sound or consumption of electricity due to the driving of the fan can be reduced.

In the image forming apparatus described above, it may be preferable that the controller controls the fan so as to rotate at the second predetermined speed when a plurality of recording sheets are discharged successively to the discharging portion. With this construction, if the plurality of recording sheets are discharged successively to the discharging portion, the fan can be controlled so as to rotate at the high speed. On the other hand, if only one recording sheet is discharged in the discharging portion (single discharging), the fan can be controlled so as to rotate at the low speed. Accordingly, the rotational speed of the fan can be increased only when the successive discharging which may generate sticking of papers is made. Consequently, sticking of recording sheets discharged in the discharging portion can be suppressed while undesired sounds and consumption of electricity can be reduced.

This application is based on patent application No. 2005-166820 filed in Japan, the contents of which are hereby incorporated by references.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds are therefore intended to embraced by the claims.

What is claimed is:

1. An image forming apparatus comprising:

a main body;

a displaying portion for displaying information concerning the image forming apparatus, the displaying portion being movable with respect to the main body of the image forming apparatus; and a fan for cooling the displaying portion, the fan being mounted in the displaying portion.

2. An image forming apparatus according to claim 1, further comprising a discharging portion to which a recording sheet is discharged, the discharging portion being provided on a back of the displaying portion, wherein the displaying portion includes a back surface casing having an air hole, and the fan is operable to send air to a recording sheet discharged in the discharging portion through the air hole.

3. An image forming apparatus according to claim 1, wherein the displaying portion includes a display panel and a display circuit board for use with the displaying panel, the display circuit board having a heat generative component.

4. An image forming apparatus comprising:

a main body;

a displaying portion for displaying information concerning the image forming apparatus, the displaying portion being movable with respect to the main body of the image forming apparatus, the displaying portion including a back surface casing having an air hole;

a discharging portion to which a recording sheet is discharged, the discharging portion being provided rearward of the displaying portion;

a fan mounted in the displaying portion; and a duct for leading an air flow generated by the fan to at least either one of the fan or the air hole so that the air flow generated by the fan cools the displaying portion and sends air through the air hole and to a recording sheet discharged in the discharge portion.

5. An image forming apparatus comprising:

a main body;

a displaying portion for displaying information concerning the image forming apparatus, the displaying portion being movable with respect to the main body of the image forming apparatus, the displaying portion including a back surface casing having an air hole;

a discharging portion to which a recording sheet is discharged, the discharging portion being provided rearward of the displaying portion;

a fan mounted in the displaying portion to generate a flow of air for cooling the displaying portion and for sending air through the air hole and to a recording sheet discharged in the discharging portion; and a controller which controls the fan so as to rotate at a first predetermined speed when the apparatus is in a standby state and at a second predetermined speed faster than the first predetermined speed when the apparatus is in an operation state.

6. An image forming apparatus according to claim 5, wherein the controller controls the fan so as to rotate at the second predetermined speed when a plurality of recording sheets are discharged successively to the discharging portion.

7. An image forming apparatus comprising:

a main body; and a displaying portion for displaying information concerning the image forming apparatus, the displaying portion being movable with respect to the main body of the image forming apparatus and having a housing which is independently separable from the main body, wherein the main body includes an upper section for reading a document image, a lower section provided under the upper section for printing an image on a recording sheet, and a middle discharge portion provided in a space between the upper section and the lower section, and the displaying portion is mounted on the upper section, and a fan for cooling the displaying portion is provided within the housing.

8. An image forming apparatus according to claim 7, wherein the displaying portion includes a back surface casing having an air hole, and the fan is operable to send air to a recording sheet discharged in the middle discharge portion through the air hole.

9. An image forming apparatus according to claim 8, wherein the displaying portion is provided with a duct which extends from the fan to the air hole.

10. An image forming apparatus according to claim 9, wherein the displaying portion includes a plurality of air holes at a predetermined interval, and a duct which extends from the plurality of air holes to the fan.

11. An image forming apparatus according to claim 7, wherein the displaying portion includes:

a display unit having a display panel for displaying information; and a supporting unit for supporting the display unit at a bottom of the displaying unit, the supporting unit being pivotally mounted to the upper section, the display unit includes a display circuit board for use with the display panel, the display unit having a heat generative component, and the supporting unit is provided with a fan for cooling at least the heat generative component.

12. An image forming apparatus according to claim 11, wherein the displaying portion includes a duct which extends from the fan to the heat generative components.

13. An image forming apparatus according to claim 11, wherein the display panel is a color liquid crystal display panel.

14. An image forming apparatus according to claim 11, wherein the supporting unit includes an air hole, and the fan is operable to send air to a recording sheet discharged in a discharge portion in the main body through the air hole in the supporting unit.

15. An image forming apparatus according to claim 7, further comprising a controller which controls the fan so as to rotate at a first predetermined speed when the apparatus is in a standby state and at a second predetermined speed faster than the first predetermined speed when the apparatus is in an operation state.

16. An image forming apparatus according to claim 15, wherein the controller controls the fan so as to rotate at the second predetermined speed when a plurality of recording sheets are discharged successively to the discharging portion.

* * * * *